United States Patent [19]

Duplessy

[11] Patent Number: 4,593,709

[45] Date of Patent: Jun. 10, 1986

[54] MACHINE FOR SORTING, PACKAGING AND DISPENSING OF COINS

[76] Inventor: Christian J. Duplessy, Les Hoteaux, Brindas (Rhone), France

[21] Appl. No.: 614,871

[22] Filed: May 29, 1984

[30] Foreign Application Priority Data

May 27, 1983 [FR] France ..... 83 09117

[51] Int. Cl.[4] ..... G07D 3/04

[52] U.S. Cl. ..... 133/3 D; 133/8 A

[58] Field of Search ..... 53/254; 133/3 D, 8 A, 133/3 C; 209/682

[56] References Cited

U.S. PATENT DOCUMENTS 454,653 6/1891 Kirkmeyer ..... 133/3 D 539,885 5/1895 Taylor ..... 133/3 D

FOREIGN PATENT DOCUMENTS 45929 2/1889 Fed. Rep. of Germany ..... 133/3 D

*Primary Examiner*—Stanley H. Tollberg

*Attorney, Agent, or Firm*—Karl F. Ross; Herbert Dubno

[57] ABSTRACT

A coin counter, dispenser and packaging device in which the coins pass downwardly along a ramp whose holes are of gradually increasing diameter downwardly and are defined by plates whose portions remote from a wall of a ramp are set back slightly more than the diameter of the coins adapted to pass through the holes so that the coins ride along this wall. Below the tubes in which the coins are collected beneath the ramp the support bars are provided which can be actuated to drop stacks of coins into sleeves with transparent sacks for packaging the coins. When the dispensing tray is fixed in place, these support bars are pressed back and the stacks are freed to rest upon the dispensing tray and ejector bars can be operated to discharge the coins one by one.

7 Claims, 11 Drawing Figures

MACHINE FOR SORTING, PACKAGING AND DISPENSING OF COINS

FIELD OF THE INVENTION

My present invention relates to a machine or device for dispensing, sorting, packaging and counting of coins and, more particularly, to a coin sorting, packaging and dispensing machine which is particularly suitable for use in small commercial establishments, bank branches and like locations in which considerable but nevertheless comparatively small quantities of coins must be handled.

BACKGROUND OF THE INVENTION

Machines for counting of coins or for the packaging or sacking thereof or for dispensing are relatively complex and generally several functions of such machines have not been fully compatible with one another.

In other words, special means were usually provided for each or several of these functions.

The machines which were provided heretofore and designed primarily to handle very large numbers of coins daily, were generally very sophisticated and complex.

In one sorting-counting machine, for example, a rotary distributing plate lifts the coins previously dumped into a feed funnel onto a inclined ramp whose width is substantially equal to the thickness of a coin, which descends along this ramp while rolling on the edge.

Deflectors are disposed above the ramp and at distances decreasing from the latter deflect the coins, each distance being just smaller in diameter than the respective coin. The coins pass the deflectors until they reach one of appropriate height above the ramp and are thereby sorted as to size.

The coins may be sorted a second time utilizing similar means and are then transferred from the tubes in which they are collected into preformed paper sleeves for packaging or sacked for bulk money storage.

In another prior art sorter-counter, the sorting of the coins is effected by a highly sophisticated electronic selector. These means generally also have at least one motor for rotating a distribution plate and various complex electronic components associated with the plate for classifying the coins. Not only are the components of high cost so that the machine is highly expensive but the machine is prone to breakdown because of the large number of parts and their complexities.

Other machines are more highly specialized. There are sorters, sorter-counters, packaging machines for introducing coins into wrappers and machines which are designed primarily for the handling of large numbers of coins per unit/time, e.g. up to 2000 coins per minute. These latter machines are not convenient for small business, small bank branches and other users who require the processing of lesser quantities of coins.

OBJECTS OF THE INVENTION

It is, therefore, the principal object of the present invention to overcome these drawbacks and provide an improved machine for the sorting, counting and, selectively, the dispensing of individual coins or the packaging of stacks of coins whereby the disadvantages of earlier systems are obviated.

Another object of the invention is to provide a machine of this type in which the handling of the coins is greatly simplified, especially for small business, small bank branches and the like.

It is also an object of this invention to provide a machine of this type which has a relatively simple and thus highly reliable construction, is of low cost and nevertheless can process comparatively large numbers of coins.

Still another object of this invention is to provide a machine which, when operated in a packaging mode, is capable of producing packaged coin in a form in which it is more convenient to handle than the paper-wrapped coin rolls widely used heretofore.

SUMMARY OF THE INVENTION

These objects and others which will become readily apparent hereinafter are attained in a machine which comprises a machine body having a ramp for sorting of the coins which is inclined downwardly, means for feeding the coins in succession to this ramp, a plurality of tubes of different diameter corresponding to coin size disposed below this ramp, a plurality of holes on the ramp aligned with these tubes and of a progressively increasing diameter downwardly along the ramp, the ramp having an outer wall and being tilted or otherwise oriented so that the coins tend to ride along this wall as they descent the ramp, the holes being defined in sorting plates adjustably affixed on the rim and extending from the opposite side of the ramp. The hole boundary remote from the outer wall is thus spaced from the latter by a distance slightly greater than the diameter of the coin. As a consequence the coins can ride along the outer wall with their edges adjacent this wall always supported on a ledge and as they reach a hole of the appropriate diameter ramp therethrough. In this system, therefore, the coins are sorted in holes of increasing diameter in the descent along the ramp.

To avoid the possibility that a coin because of its kinetic energy or momentum will not fall through an appropriate hole, each hole has a length greater than the diameter, i.e. is elongated to ensure that the coil will tumble into the corresponding tube. Preferably, the longitudinal angle of inclination of the ramp to the horizontal is between 15° and 20°, this being sufficient to ensure a sufficient velocity without imparting excessive kinetic energy to the coins.

To ensure retention of the coins during their descent against the outer wall, the ramp can have a slight downward inclination in the transverse direction toward the exterior.

The coins can be fed to the sorting ramp from a feed ramp inclined in the opposite direction from above and connected to the sorting ramp by a bend which assists in supporting the coins and in reducing the velocity.

At the outlet side of the bend a bar can define a slot of a width and height slightly greater respectively than the largest diameter and greatest thickness of the larger size coin which is to be passed, thereby preventing the coins from passing two at a time down the sorting ramp. This assists in eliminating sorting errors.

According to a feature of the invention, each sorting plate has an elongated hole by which it is affixed to the ramp by a screw to enable adjustments of the effective diameter of each plate for the particular coin to be sorted therethrough. The ramp can have recesses in which the plates are inset to provide a smooth or planar surface for the descent of these coins.

For use of this machine in the packaging of coins, a support bar is provided at the bottom of each collecting tube and can be displaced between a rest position in which a stack of coins can accumulate thereon into a withdrawn position in which the stack is permitted to drop into a sleeve which can be disposed on a seat provided in the support body below the tube. The packaging foil can be drawn over the sleeve and can receive the stack of coins.

For dispensing coins, the dispensing tray can be applied to the front of the machine and can automatically press back the support bars to allow the stack of coins to be supported on surfaces of various heights on the tray. The tubes are each provided with a respective ejector bar which can be drawn forwardly by an actuating rod to eject the bottommost coin into the tray. The support and ejector bars may be coupled and may each have respective springs anchored to opposite flanges of a U-shaped profile member through openings of which the bars can extend.

Each package can be formed from a tubular sack of a transparent plastic material, e.g. polyethylene, closed at one end and provided with a tongue at its other end to facilitate the introduction of a rigid filling sleeve into the foil sack. Advantageously, each sack is formed by a foil of rectangular plastic material folded twice on itself so as to provide at its closed end a gusset or extension portion of inverted V-configuration so that it is not split by the introduction of the stack of coins therein. Heat seals or thermalwelds can form the seams defining the package.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
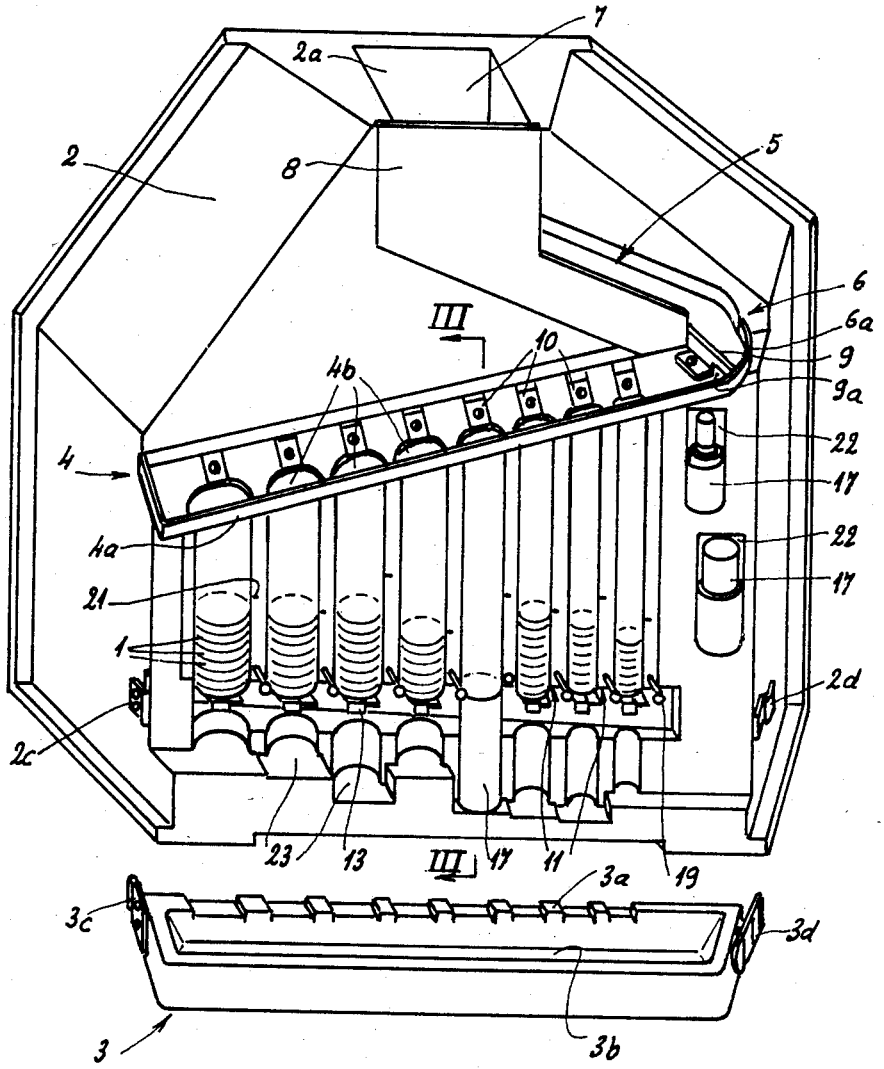
FIG. 1 is a perspective view of a device for the sorting of coins, according to the invention, preparatory to the packaging of the coins and showing the dispensing tray removed therefrom.
Figure 2:
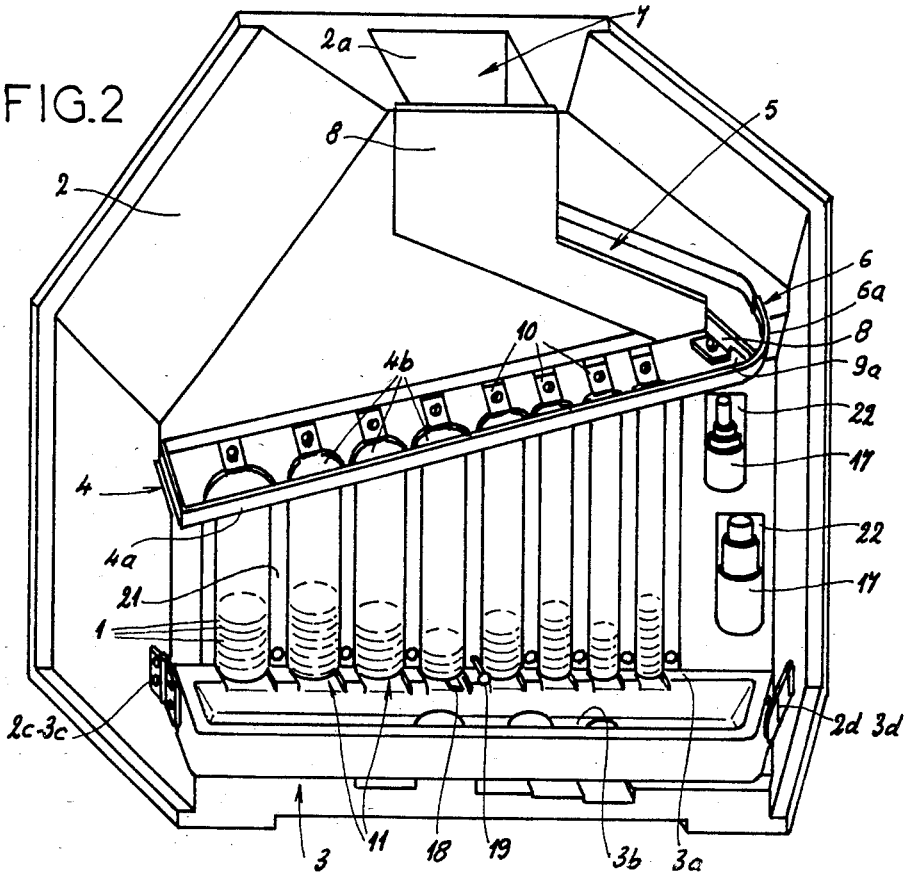
FIG. 2 is a view similar to FIG. 1 but showing the dispensing tray in place.
Figure 6:
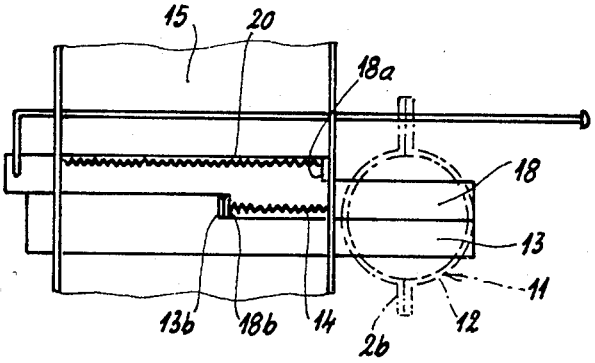
FIG. 6 is a view taken from above of the support and ejection bars.

The machine or device for the sorting, packaging, counting or distributing or dispensing of coins 1, shown in FIG. 1, comprises principally a block or body 2 of generally parallelopiped form to which a distribution tray 3 can be attached. Members 2*c* and 2*d* form catches engageable with members 3*c* and 3*d* to retain the tray 3 on the body 2 of the machine. When the distribution or dispensing tray 3 is in place, it obscures the region adapted to receive the packaging materials or sacks for the coins and thus automatically converts the machine from a coin-packaging or sacking machine into a dispensing or distributing machine. In the latter mode, the coins from the various columns can be dispensed individually.

On the vertical forward face of body 2, there is fixed a sorting ramp 4 inclined by about 15° to 20° to the horizontal. An auxiliary ramp 5 is fixed upstream of the ramp 4 and has an opposite inclination to the latter so as to form a bend in the shoot defined by the ramps. This bend is represented at 6.

Above the upper end of the auxiliary ramp 5, a vertical hopper or channel 7 is provided into which the coins can be dumped. The floor of this hopper or channel is defined by the ramp 5. The channel 7 is formed in the upper portion of the block 2 as a groove 2*a* which is closed by a removable retaining plate 8 which can be transparent so that the flow of the coins along the ramps can be viewed. The retaining plate 8 serves to channel the coins from the hopper 7 along the ramp 5. The coins 1 then descend by gravity along the ramp 5 and are braked by the elbow 6 before they slide down the sorting ramp 7 with reduced kinetic energy.

A selection bar 9 is disposed at the outlet of the band 6 in a position intermediate between an extension of the auxiliary ramp 5 and is perpendicular to this sorting ramp 4 and has a rectangular opening 9*a* of a width and a height respectively greater than 0.1 mm above the largest diameter and the largest thickness of the coins to be sorted. The bar 9 also contributes to a sliding-down movement of the coins and does not permit the coins to pass except singly on to the sorting ramp. Thus the coins must pass one by one on to the sorting ramp and two coins cannot pass stuck together or simultaneously through the slot.

Because of the position of this slot 9*a* at the exterior part 6*a* of the bend 6, the bar 9 also directs the coins 1 outwardly so that they slide along the sorting ramp 4 against the external wall 4*a* therein.

To facilitate this movement of the coins 1, the ramp 4 can also be inclined toward the exterior in a transverse sense, i.e. downwardly and outwardly so that the wall 4*a* is lower than the opposite wall of the ramp.

The ramp 4 can be formed with eight holes 4*b*, one hole being provided for each type of coin into which the coinage is to be sorted. The eight holes are each associated with a respective sorting plate 10, effectively carrying out the sorting according to diameter of the coins 1.

Figure 3:
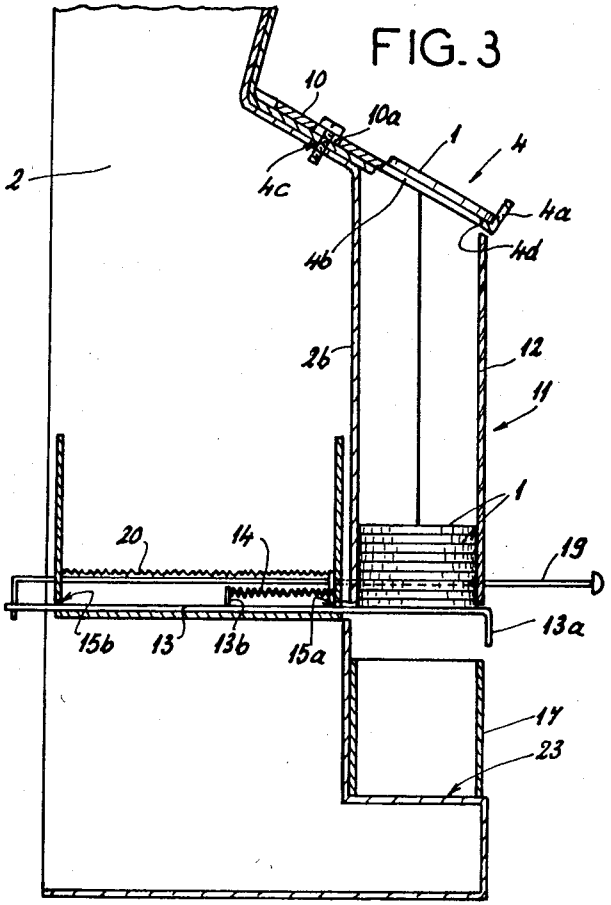
FIG. 3 is a partial section along the line III—III of FIG. 1.

The holes 4*b* do not reach the outer wall 4*a* of the ramp 4 but, on the contrary, are spaced therefrom by 3 to 4 mm such that a ledge, rib or ridge 4*d* projects inwardly to support the coins as shown in FIG. 3.

The sorting plates 10 are fixed by screws on a complementary ledge 4*c* of the ramp 4 so that the plates are recessed in the ramp and the ramp portions between the plates and the upper surfaces of the plates are flush with one another to present a planar sliding surface for the coins. The plates are also provided with oblong openings or slots 10*a* transversed by the respective retaining screws and enabling adjustment of the sorting plates along the ramp 4. This adjustment is in the transverse direction. The respective tube 11 for receiving the coins 1 is disposed vertically below each hole 4*b*. The tubes 11 are formed by the assembly of a part 2*b* of the body 2 defining semicylindrical columns and a transparent semicylindrical wall 12 which completes the tube 11 as shown in FIG. 3.

The receiving tubes 11 and the holes 4b have a diameter increasing from right to left, i.e. in the direction of descent of the coins along the ramp. The diameter of each receiving tube 11 can correspond to the diameter of the coin 1 to be collected in that tube.

Each sorting plate 10 is disposed at a distance x from the outer wall 4a of the ramp 4 just greater than the diameter of the coins adapted to be passed therethrough increased by 0.1 mm to take into account possible deformations of the coin.

The coins 1 introduced into hopper 7 descend along ramp 5 by gravity and are slowed down at the band 6, separated and directed by the selection bar 9 onto the ramp 4 at a low velocity.

These coins then slide in a flat state along the ramp 4 against the wall 4a and as each coin 1 arrives at the hole 4d of corresponding diameter, it passes through the selection hole in the respective selection plate 10. At this point, the coin is supported at its outer tip on the ledge 4d but not its upper or inner edge and the coin thus tumbles into the respective hole and downwardly into the corresponding tube 11 so as to be stacked as shown in FIG. 3. The coins are sorted in the sense of the increasing diameter during the descent along the ramp 4 and the holes 4b can be somewhat elongated in the transverse direction to facilitate the tumbling of a coin of proper size into the appropriate holes.

When the coins are thus sorted, the machine according to the invention permits counting, packaging or distribution or dispensing as will be described in greater detail below.

Figure 4:
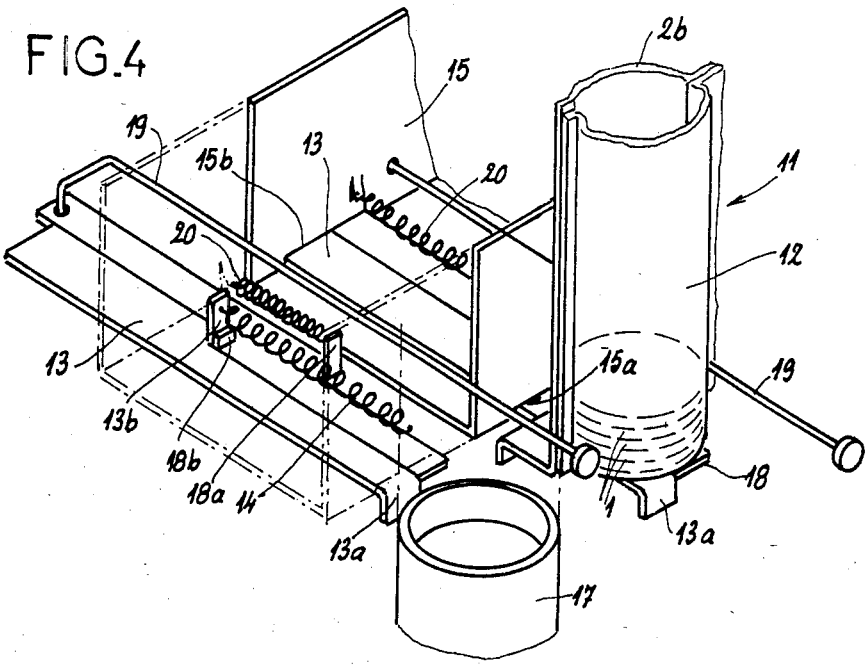
FIG. 4 is a perspective view drawn to a larger scale and constituting a detail of the bars which are used to support a stack of coins and eject a coin or a stack thereof in a position for packaging of the coins.

FIG. 4 shows the principles of the operation of the device when utilized for counting and packaging of the sorted coins. Each collection or receiving tube 11 is closed at its lower end by a support bar or plate 13 which can be flat and of rectangular outline and whose front end is bent downwardly to form a flange or finger 13a. The support bar 13 is also provided with an upstanding lug 13b which can be bent from a portion of the bar. The lug 13b is anchored to one end of a tension spring 14.

The support bar 13 is adapted to slide in openings 15a and 15b formed respectively in the front and rear flanges of a channel or profile member 15 of U-configuration fixed behind the face panel of the machine.

The shifting of this support bar 13 is effected between the rest position in which the bar encloses the tube 11 and corresponding to the position of the right-hand bar 13 in FIG. 4 and into a retracted position as illustrated for the left-hand bar 13 in FIG. 4 and out of which the bar is biased by the spring 14. The other end of the spring 14 is anchored to the front flange of the profile member 15. In this latter position the coins 1 can drop directly from the tube 11 through a packaging or guide sleeve 17 into a sack 16 in which these coins are to be packaged.

Consequently, when a sufficient number of coins collect in the tube 11, viewable from the exterior via the transparent wall 12, the bar 13 can be released to allow the coins to drop into the sack 16. The number of coins per sack for a given coin value is generally standardized or accepted by the banks in a particular area.

The number of coins 1 in each collecting tube 11 can be indicated by a scale or marker 21 provided alongside each tube 11.

The device of the present invention packages the coins in sacks rather than the paper sleeves hitherto widely utilized for such coin packaging. The seams can be composed of polyethylene or other synthetic resin foil or film material and generally is transparent and heat-sealed at the closed bottom end of the sack.

Figure 7:
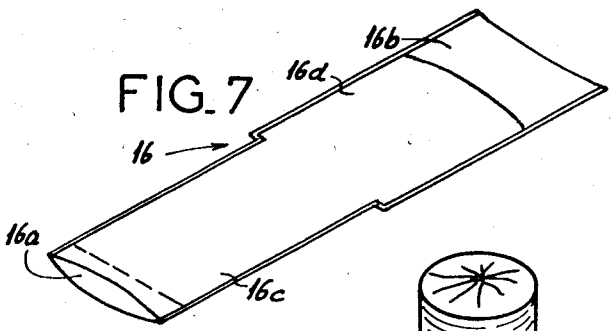
FIG. 7 is a perspective view showing a packaging sack in its flattened state.

Consequently, it is advantageous to provide a gusset or expansion zone 16a at the closed end and a tongue 16b at the open end of each tube. Depending upon the diameter of the tube, which of course is accommodated to the diameter of the coins to be received therein, the open end of the sack can be provided (see FIG. 7) with a larger diameter portion 16d adapted to be drawn over the rigid guide or filling sleeve 17 (FIG. 8) in an accordion-pleated fashion. The smaller diameter portion 16c can be of a diameter less than that of the sleeve but nevertheless sufficient to receive the stack of coins. It has been found to be advantageous to make both the small diameter portion 16c and the large diameter portion 16d of substantially equal lengths and each able to receive a stack of coins of the respective height. The advantage of the transport sacks over standard paper coin rollers is that the transparent sacks facilitate recognition of the contents of the package.

Each sleeve 17 has an inner diameter just slightly larger than the diameter of the coins to be fed therethrough to the sack and a length and a height at least equal to the standard height of the stack of coins to be accommodated.

Semicylindrical seats 22 are provided on the front face of the body 2, extending the walls 2b downwardly to allow the sleeves to be positioned below the respective tubes 11 (see FIG. 3).

Figure 8:
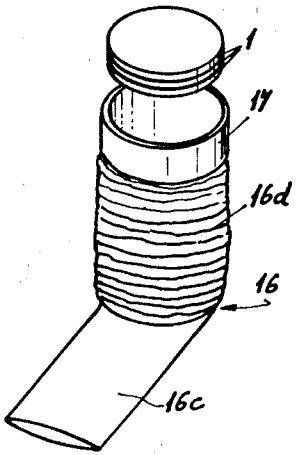

For packaging, a sack 16 is then threaded over a respective sleeve 17 in an accordion-pleated fashion as shown in FIG. 8 while leaving the section 16c extended. The sleeve is then placed tin the machine as shown in FIG. 3 and the support bar 13 is pressed inwardly by its downwardly extending finger of the flange 13a. The coins of the accumulated stack are thus permitted to fall into the sleeve 17 until the latter is filled. The sleeve is then withdrawn with the coins in place and the stack of coins drops into the section 16c of the sack. With the removal of the sleeve 17, the support bar 13 is freed and returns to its rest position shown in FIG. 3 through the action of the spring 14.

Figure 9:
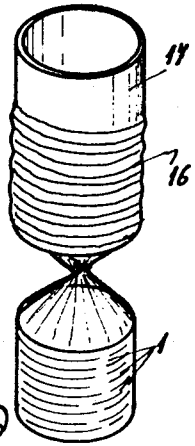

The rest surfaces 23 for the sleeves 17 are located at deeper levels for each of the tubes 11 and hence for each of the coin sizes as clearly visible from FIG. 1. The distance between the seat 23 for each coin type and the respective tube 11 is, of course, at least equal to the length of the respective filling sleeve 17. When the sleeve 17 is filled with a stack of appropriate height, the sleeve can be lifted to transfer this stack to the lower portion 16c of the sack (FIG. 9) and the resulting package closed by twisting the lower portion of the sack to close the package and seal the bottom of the remaining portion of the sack on the sleeve 17.

The sack can then be freed and is easily opened by pulling apart the twisted portion. The remainder of the sack now can form another package which can receive an additional stack of coins with the sack withdrawing progressively from the sleeve and being twisted when the proper height of the coins is contained therein.

Figure 10:
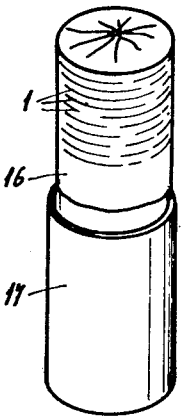
FIGS. 8 through 11 are views illustrating various steps in the packaging of the coins.
Figure 11:
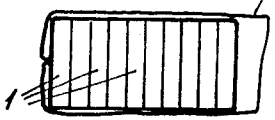

The resulting package can be seen in FIG. 10. It is possible to fill a synthetic resin foil sack by allowing the same to be withdrawn into the sleeve as well and progressively drawn of an edge of the latter or by any other convenient means utilizing the filling sleeve discretely.

In order to utilize the machine for the individual distribution of coins, i.e. for the dispensing of coins one at a time, the tray 3 is fitted onto the body 2 utilizing the fittings 2*c*, 3*c* which can form a hinge and the fittings 2*d*, 3*d* which can form a latch tightening the tray 3 on the body 2. The tray 3 has a substantially planar portion 3*a* and a concavity 3*b* formed thereon and adapted to receive the coins falling from the tubes 11. Once the tray is attached to the body 2, it has a rear portion 3*e* which can abut a vertical surface of the body 2 beneath the bars 13. The rear of the tray is notched at 3*f* in alignment with respective tubes 11 and sufficient to enable a coin to drop onto the horizontal surface of each recess 3*f*. When locked in place, the tray 3 engages the downwardly extending flanges 13*a* to press all of the support bars 13 back into nonsupporting positions of these bars.

The distance between each support face 3*f* and the bottom of each tube 11 is only slightly greater than the thickness of the coins received in each tube so that the surface 3*f* must be located at different levels as shown. This ensures that only a single coin can slide from beneath each tube 11 along the surface 3*f*.

The ejection of the coins one by one onto the dispensing tray 3 is effected by an ejection bar 18 and an ejection pin 19 rigidly connected to each such bar.

Figure 5:
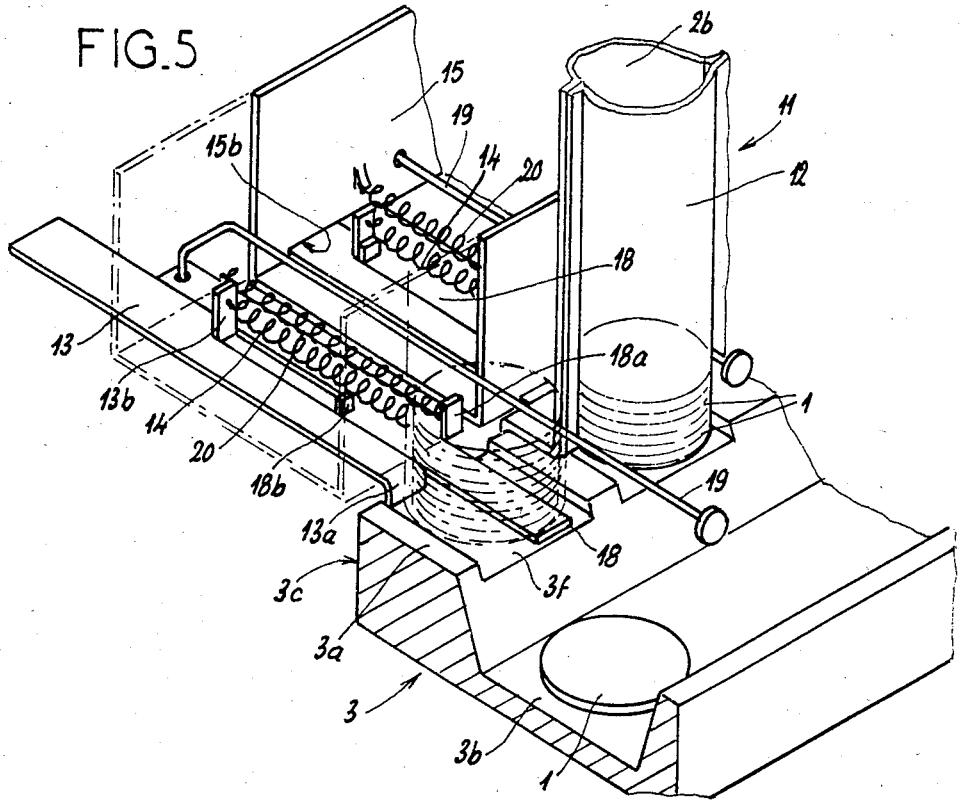
FIG. 5 is a similar view of the device in the position thereof for distribution, i.e. with the dispensing tray in place.

Each ejection bar is provided for a respective one of the tube 11 and can slide in the openings 15*a* and 15*b* of the channel 15 between a rest position as shown for the bar 18 on the right-hand side of FIG. 5 in which the free end of the bar lies behind the stack of coins and toward which the bar is urged by a traction spring 20 connected to this bar and to the rear flange of the channel 15. The bar is dimensioned to pass between the surface 3*f* and the lower end of the respective tube to eject a coin when the rod 19 is drawn forwardly into the position shown at the left-hand side of FIG. 5.

The spring 20 is connected to a lug 18*a* of the bar 18. A lug 18*b* lies in the path of the lug 13*b* of the corresponding bar 13 so that the two bars are coupled and are drawn forwardly by the spring 14 when the device is to be utilized for packaging space of coins. This enables the rod 19 to be pressed rearwardly to entrain the bar 13 in this direction for release of a stack.

When the machine is used for dispensing coins, the spring 14 of each support bar is neutralized because this support bar is held in its rear position by the engagement of the surface 3*e* of the tray with the support bar. Thus the dispensing bar 18 is not acted upon by the spring 14 in this condition.

Each ejection rod 19 is constituted by a metallic rod secured to the rear of the respective ejection bar. When the ejection bar 18 is in its rest position, the drawing of the rod 19 forwardly shifts the bar into its working position in which it pushes a coin from below the respective tube 11 into the concavity of the dispensing tray. The bar 18 is retained at its rest position by the spring 20 and likewise returns the ejection rod 19 to its rest position.

The machine of the invention can be used in small commercial establishments, bank branches and other locations at which relatively small quantities of coins may have to be sorted, counted, packaged and distributed. It is possible to provide beneath the dispensing tray a drawer for bills and paper or documents, bank notes and the like. Naturally, the invention described is not limited to the specific embodiment illustrated but may be embodied in various forms within the spirit and scope of the applied claims.

I claim:

1. A coin-sorting, packaging and dispensing machine, comprising:

a support;

a downwardly inclined ramp on said support having an outer edge and an inner edge;

means including a plurality of sorting plates secured on said ramp at spaced-apart locations therealong defining respective holes of successively increasing diameter and positioned so that an edge of a hole remote from said outer wall is slightly greater than the diameter of a coin adapted to pass through said hole;

means for feeding coins to said ramp at an upper end thereof whereby said coins slide down said ramp along said wall and tumble through respective holes;

respective downwardly open collecting tubes registering with said holes below said ramp for accumulating stacks of coins of the size corresponding to the size of the respective hole; and a U-section channel having a front flange and a rear flange, said bar having a downwardly extending finger enabling the displacement thereon rearwardly through openings provided in said flanges and an upstanding lug, said support being formed with a respective seat beneath each tube for receiving a guide sleeve over which a transparent foil sack is drawn, said sleeve, upon being positioned below the respective stack, pressing a respective finger and support bar back to free a respective stack of coins whereby said sleeve guides said coins into the respective sack.

2. The machine defined in claim 1 wherein each sack has a length at least greater by 50% than the length of sack required to accommodate a respective stack thereby enabling the portion of the sack receiving the respective stack to be twisted off from the remainder therein.

3. The machine defined in claim 2 wherein each sack has a large diameter portion formed with a tongue on one end of the sack and a closed small diameter portion formed with a gusset at the opposite end of the sack.

4. The machine defined in claim 3 wherein the diameter of said small diameter portion is substantially equal to the diameter of the coin in the stack to be received therein and to the external diameter of the respective sleeve while the large diameter portion has a diameter equal to the external diameter of said sleeve.

5. The machine defined in claim 1, further comprising a dispensing tray having a plurality of surfaces disposed below said tubes and positioned to support said stacks but spaced from said tubes by distances only slightly greater than the thicknesses of the coins of the respective stacks, said tray being engageable with said support bars for displacing same out of supporting engagement with said stacks, and means for securing said tray releasably to said support.

6. The machine defined in claim 5 wherein an ejector bar is provided for each of said tubes and is displaceable between the respective surface and the lower end of the respective tube on said channel, and actuating means connected to each of said ejector bars for enabling manipulation thereof to eject a coin from a respective slot into the respective tray.

7. The machine defined in claim 6 wherein a respective spring is provided between the rear flange and each of said ejector bars for normally retracting same from beneath the respective tube.

* * * * *